US007188381B2

(12) United States Patent
Lombert

(10) Patent No.: US 7,188,381 B2
(45) Date of Patent: Mar. 13, 2007

(54) PRAYER CUSHION

(76) Inventor: Elois Lombert, 546 S. Fairfax Ave., Los Angeles, CA (US) 90036

( * ) Notice: Subject to any disclaimer, the term of this patent is extended or adjusted under 35 U.S.C. 154(b) by 425 days.

(21) Appl. No.: 10/777,595

(22) Filed: Feb. 13, 2004

(65) Prior Publication Data

US 2005/0189809 A1 Sep. 1, 2005

(51) Int. Cl.
*A47C 16/04* (2006.01)

(52) U.S. Cl. ..... 5/648; 5/630; 5/652; 5/655.9; 297/423.11; 297/423.41

(58) Field of Classification Search ..... 5/648, 5/650, 652, 655.9; 297/423.1, 423.11, 423.17, 297/423.39, 423.41
See application file for complete search history.

(56) References Cited

U.S. PATENT DOCUMENTS 2,448,427 A * 8/1948 Gordon ..... 280/32.5
2,748,838 A * 6/1956 Scholl ..... 297/423.41
5,134,740 A * 8/1992 Summer ..... 5/652
6,298,508 B1 * 10/2001 McCloskey ..... 5/632
6,578,217 B1 * 6/2003 Roberson ..... 5/632
6,810,541 B1 * 11/2004 Woods ..... 5/420
2003/0019007 A1 * 1/2003 Spencer ..... 2/24
2006/0113831 A1 * 6/2006 Cancer ..... 297/423.41

* cited by examiner

*Primary Examiner*—Michael Trettel
(74) *Attorney, Agent, or Firm*—Park Law Firm

(57) ABSTRACT

A portable prayer cushion comprises a top surface partitioned to a front portion and a rear portion, the front portion including first and second loop lines each having a foremost. A first imaginary line through the first foremost point toward the rear portion is substantially parallel to a second imaginary line through the second foremost point toward the rear portion where surface portions inside the loop lines are recessed to form first and second openings.

12 Claims, 3 Drawing Sheets

PRAYER CUSHION

BACKGROUND OF THE INVENTION

This invention generally relates to a cushion. More particularly, the present invention relates to a portable prayer cushion facilitating a user to comfortably kneel thereon for prayer irrespective of locations.

A steady number of church goers or piety people prefer kneeling for their religious prayer to simply closing their eyes with his or her posture unchanged. When they feel like praying at work or home, they try to kneel on uninvited carpets, hardwood floors or tile floors. What is inevitably required for those who want to pray, for example, half an hour or more is a seat cushion. However, since such a conventional cushion is designed and manufactured for being placed in abutment with a user's posterior, a cover layer is accompanied. Most of all, kneeling on the conventional cushion leads the knees to slide apart so the users have to drag side to side the knees from time to time, unfavorably resulting in distraction and discomfort.

Further, considering the top portion of the cushion being in abutment with the user's posterior, an additional layer is required in the conventional cushion. Such an additional top layer of the seat cushion causes inconveniences when knelt thereon due to the slipping-against properties between the top layer and the insertions within the cushion. That is, kneeling on the top layer easily causes to the top layer to become displaced from the insertions or stuffing material in the conventional cushion.

A demand is manufacture of a cushion that satisfies those who want to pray on their knees wherever they are and whenever they want. Another demand is to have such a cushion flexible in weight and pressure distribution.

SUMMARY OF THE INVENTION

The present invention is contrived to overcome conventional disadvantages. Accordingly, it is an object of the invention to provide a portable prayer cushion that facilitates a user to comfortably kneel thereon. Another object is to enable a user to kneel on the prayer cushion for an extended time period without pressure on the body. A further object is to provide stability to the user's kneeling posture throughout the prayer session.

To achieve these and other objects, the portable prayer cushion according to the present invention comprises a top surface partitioned to a front portion and a rear portion, where the front portion includes first and second loop lines each having foremost and rearmost points. Here, a first imaginary line through the first foremost point toward the rear portion of the top surface is substantially parallel to a second imaginary line through the second foremost point of the second loop line toward the rear portion of the top surface. In a preferred version, the first imaginary line through the first foremost and rearmost points of the first loop line may be substantially parallel to the second imaginary line through the second foremost and rearmost points of the second loop line. For better performance, surface portions inside the loop lines are recessed to form first and second openings. A peripheral surface is provided to be substantially perpendicular to the top surface.

In an embodiment, the cushion is rearwardly slanted from about a mid line dividing the front portion and the rear portion so that the cushion makes a rearward down-slope from the mid line. Selectively, the cushion may be rearwardly slanted from about the rearmost point of each loop line so that the cushion makes a rearward down-slope from the rearmost point.

For storage and setting conveniences, the rear portion may be provided to become hingedly foldable over on the front portion by the first folding line. In a preferred version, the rear portion is partitioned to a first part and a second part by a second folding line with the first part between the front portion and the second part so that the second part is hingedly foldable over on the first part.

The top surface borders the peripheral surface by a front edge line, a rear edge line and side edge lines, and the front edge line is linear and perpendicular to the first and second imaginary lines. Also, the first and second loop lines are linearly aligned along the front edge line. Preferably, the side edge lines are each linear and substantially longer than the front edge line, and the front and rear portions of the top surface are about the same as each other in area. The first and second loop lines may be respectively circular or, elliptical. The first and second openings are respectively semi-spherical or oval.

In a preferred mode, the top surface is selectively tapered around the rearmost points to form a streamlined curvature from the top surface into the openings, and the cushion is formed of an elastic foam material or preferably of an elastic polyurethane foam material. For a better version, a lowermost point in each of the first and second openings is positioned substantially closer to the foremost points than to the rearmost points, and the depth from the top surface to the lowermost point is about one fifth, preferably, between about a half and two thirds the thickness of the prayer cushion.

The advantages of the present invention include that: (1) the portable prayer cushion facilitates its user to comfortably kneel thereon for prayer without regard to locations, thereby enhancing usability and utility; (2) the openings in the top surface serve to stabilize the user's kneeling posture while preventing the knees from sliding apart, thereby maximizing product reliability; (3) the selective hinge connection mechanism serves to improve storage efficiency and convenient setting when a plurality of cushions need to be used and stored in a limited area; and (4) the elastic foam material preferably adopted for the prayer cushion reserves optimal resiliency for even distribution of weight and pressure, thus maximizing the user satisfaction.

Although the present invention is briefly summarized, the fuller understanding of the invention can be obtained by the following drawings, detailed description and appended claims.

DESCRIPTION OF THE FIGURES

These and other features, aspects and advantages of the present invention will become better understood with reference to the accompanying drawings, wherein.

DETAILED DESCRIPTION OF THE INVENTION

Figure 1:
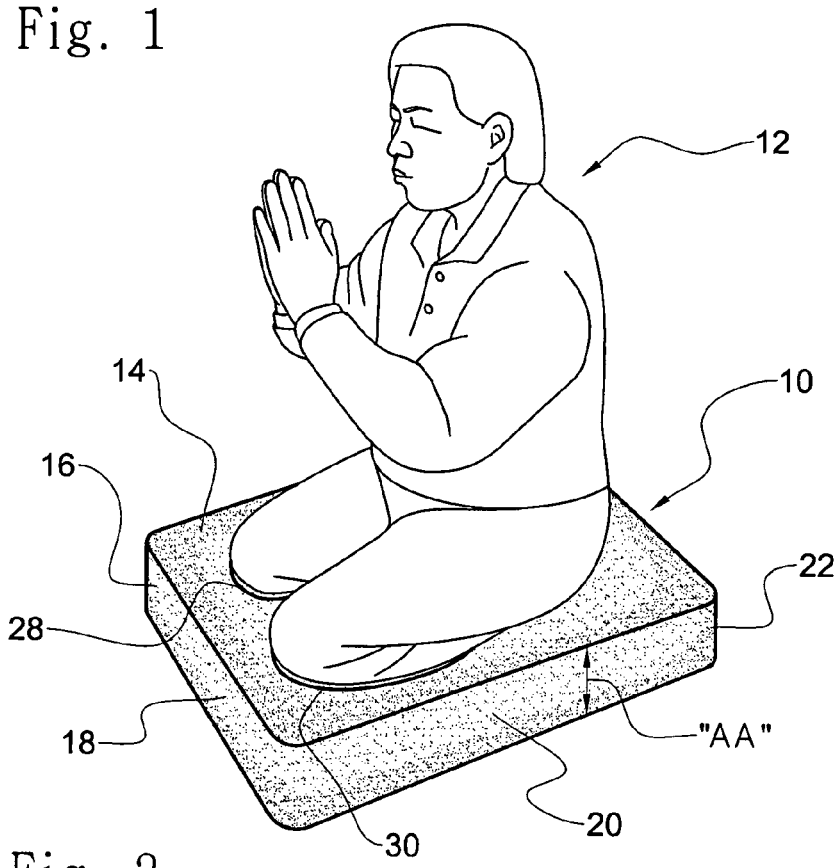
FIG. 1 is a perspective view showing a portable prayer cushion with a prayer sitting thereon according to a first embodiment of the present invention.
Figure 2:
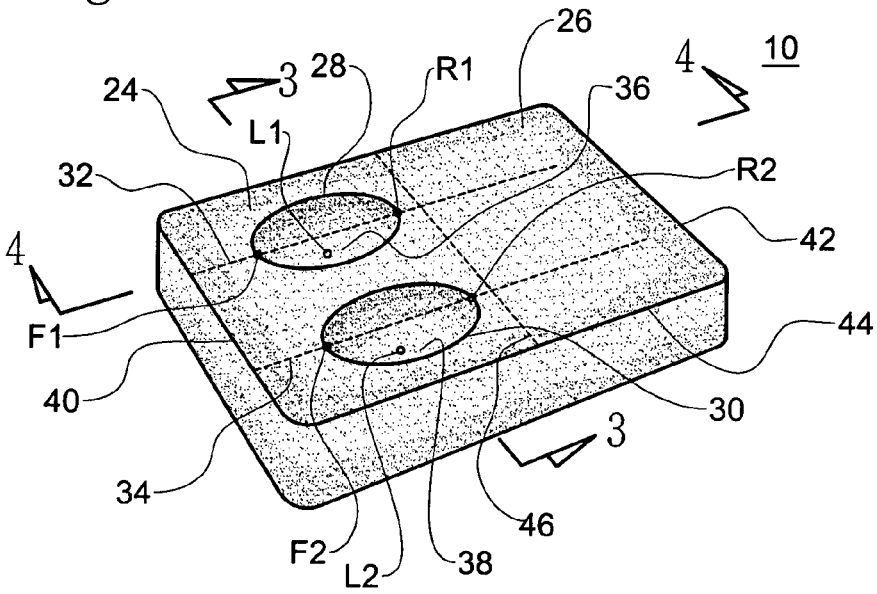
FIG. 2 is a perspective view of the prayer cushion without the prayer in FIG. 1.

FIG. 1 shows a portable prayer cushion 10 according to the present invention with a prayer sitting thereon, and FIG. 2 is a view without the prayer in FIG. 1. As shown therein, the portable prayer cushion 10 comprises a top surface 14 and a peripheral surface 16 substantially perpendicular to the top surface 14. The peripheral surface 16 may be partitioned to a front surface 18, side surfaces 20 and a rear surface 22 when the prayer cushion 10 is provided in a rectangular format.

The top surface 14 is preferably partitioned to a front portion 24 and a rear portion 26. The front portion 24 of the top surface 14 includes first and second loop lines 28, 30 each having foremost points F1, F2 and rearmost points R1, R2. In order to define the relative positions of the loop lines 28, 30, a first imaginary line 32 that runs through the first foremost point F1 toward the rear portion 26 of the top surface 14 is substantially parallel to a second imaginary line 34 through the second foremost point F2 of the second loop line 30 toward the rear portion 26 of the top surface 14.

Selectively, the first imaginary line 32 that runs through the first foremost and rearmost points F1, F2 of the first loop line 28 may be provided to become substantially parallel to the second imaginary line 34 that runs through the second foremost and rearmost points F2, R2 of the second loop line 30. In a preferred mode, surface portions inside the loop lines 28, 30 are respectively recessed to form first and second openings 36, 38.

In an embodiment, it is recommended that the top surface 14 of the prayer cushion 10 borders the peripheral surface 16 by a front edge line 40, a rear edge line 42 and side edge lines 44. Preferably, the front edge line 40 is formed linear and perpendicular to the first and second imaginary lines 32, 34. In this construction, the first and second loop lines 28, 30 are linearly aligned along the front edge line 40. Here, the loop lines 28, 30 are separated from each other. Also, the perpendicular alignment of the loop lines 28, 30 to the front edge line 40 serves to facilitate the person 12 sitting on the cushion 10 for prayer to align his or her knees as most desired for prayer.

Figure 6:
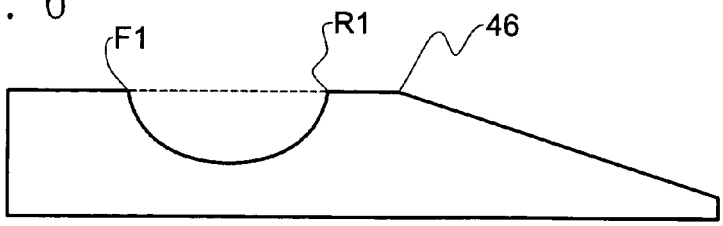
FIGS. 6 and 7 are respectively cross-sectional views to show a second embodiment of the invention.
Figure 7:
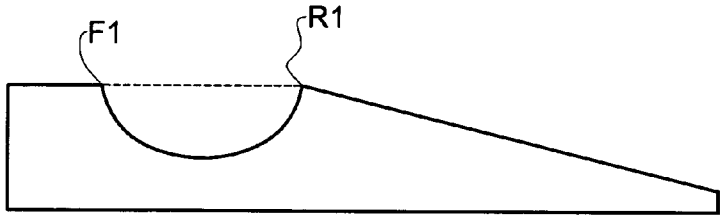

In an embodiment, as further shown in FIGS. 6 and 7, the cushion 10 is rearwardly slanted from about a mid line 46 dividing the front portion 24 and the rear portion 26 so that the cushion 10 makes a rearward down-slope from the mid line 46. Selectively, the cushion 10 may be rearwardly slanted from about the rearmost point R1, R2 of each loop line 28, 30 so that the cushion 10 makes a rearward down-slope from the rearmost point R1, R2.

Figure 8:
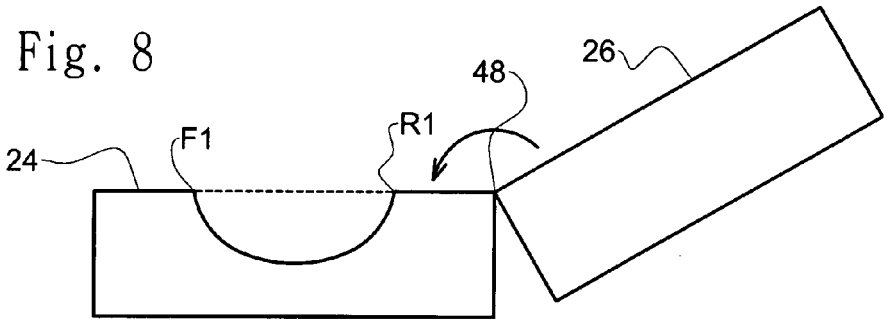
FIGS. 8 and 9 are respectively cross-sectional views to show a third embodiment of the invention.
Figure 9:
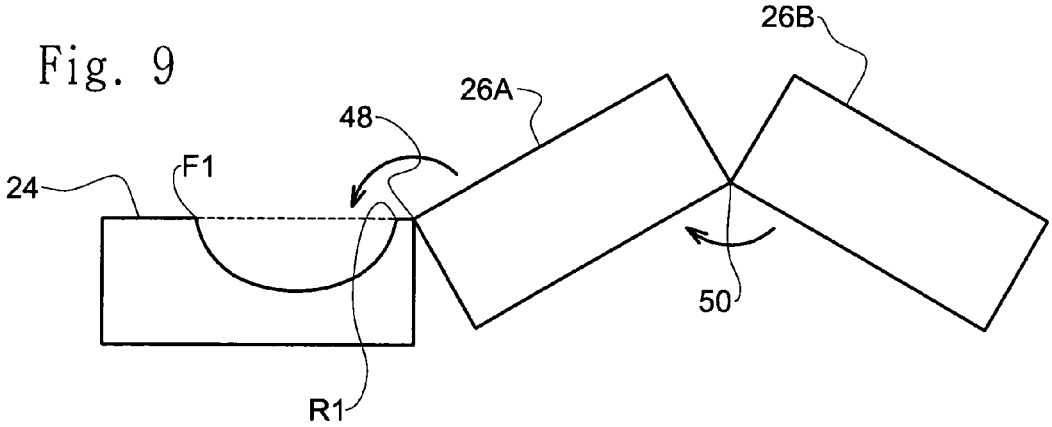

For a better performance, as shown in FIG. 8, the rear portion 26 is provided to become hingedly foldable over on the front portion 24 by the first folding line 46. As also shown in FIG. 9, the rear portion 26 is further partitioned to a first part 26A and a second part 26B by a second folding line 50 with the first part 26A between the front portion 24 and the second part 26B so that the second part 26B becomes hingedly foldable over on the first part 26A. The hinge connections 48, 50 may be implemented by use of a fabric material.

The side edge lines 44 are each linear and substantially longer than the front edge line 40 for space efficiency and the prayer's easier recognition of the openings 36, 38 at the start of kneeling for prayer. The front portion 24 of the top surface 14 may be formed equivalent to the rear portion 26 of the top surface 14. That is, the front and rear portions 24, 26 of the top surface 14 are about the same as each other in area so that the knees of the person 12 at the time of the kneeling for prayer can be easily guided toward the openings 36, 38.

The first and second loop lines 28, 30 may be respectively formed either circular or elliptical depending upon market requirements. For example, the loop lines 28, 30 of the prayer cushion 10 may be formed circular when targeted for children and elliptical when targeted for adults. The size of the loop lines 28, 30 are also variable depending upon market requirements so that the corresponding openings 36, 38 can be sized accordingly. In the meantime, the first and second openings 36, 38 may be respectively formed either semi-spherical or oval for practical purposes depending on resiliency of the material used for the prayer cushion 10.

Figure 3:
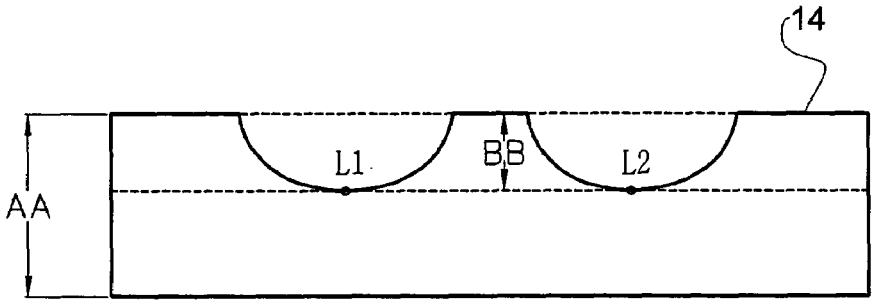
FIG. 3 is a cross-sectional view taken along 3—3 in FIG. 2.
Figure 4:
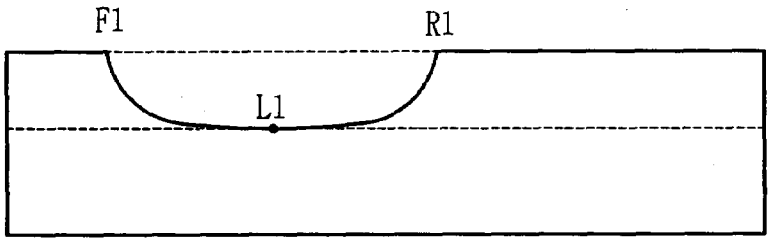
FIG. 4 is a cross-sectional view taken along 4—4 in FIG. 2 according to an embodiment of the present invention.
Figure 5:
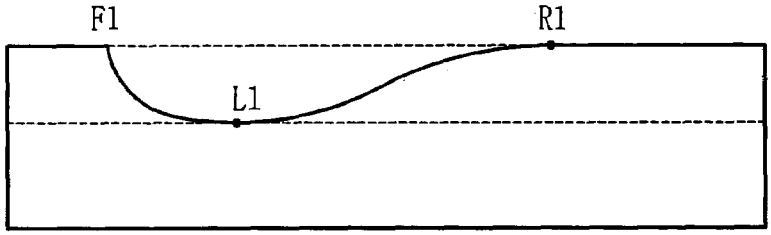
FIG. 5 is a cross-sectional view taken along 4—4 in FIG. 2 according to another embodiment of the present invention.

FIGS. 3 and 4 each show cross-sections taken along 3—3 and 4—4 in FIG. 2, and FIG. 5 shows a preferred embodiment compared to FIG. 4. As shown therein, the top surface 14 of the prayer cushion 10 is selectively tapered around the rearmost points R1, R2 to form a streamlined curvature from the top surface 14 into the openings 36, 38 as shown in FIG. 5. Such a streamlined curvature around R1 in FIG. 5 serves to provide stability in the prayer's body posture knelt for prayer as well as comfort around the leg portions in abutment with the top surface 14 because the knee portions of the prayer 12 reserves a slightly lower position relative to body parts other than the knee portions. At the same time, the knee portions stationed in the openings 36, 38 with the decently soft support by the streamlined curvature serve to substantially prevent the knees from sliding apart as witnessed in the conventional seat cushions.

In a preferred embodiment, a lowermost point L1, L2 in each of the first and second openings 36, 38 is positioned substantially closer to the foremost points F1, F2 than to the rearmost points R1, R2 so as to efficiently guide the knee portions of the prayer 12 to a stabilized and comfortable position when knelt on the prayer cushion 10. Also, the depth BB from the top surface 14 to the lowermost point L1, L2 is formed about one fifth the thickness AA of the prayer cushion 10. In a preferred version, the depth BB from the top surface 14 to the lowermost point L1, L2 is formed between about one fifth and one half the thickness AA of the prayer cushion 10.

In order to derive the best performance, it is recommended that the prayer cushion 10 be formed of a single material. Preferably, the cushion 10 may be formed of an elastic foam material. Selectively, the prayer cushion 10 may be formed of an elastic polyurethane foam material to reserve the optimal resiliency, durability and light-weighted properties.

As discussed above, an advantage of the present invention is that the portable prayer cushion 10 facilitates its user 12 to comfortably kneel thereon for prayer without regard to locations, thereby enhancing usability and utility. Further, the openings 36, 38 in the top surface 14 serve to stabilize the user's kneeling posture while preventing the knees from sliding apart, thereby maximizing product reliability. Also, the selective hinge connection mechanism serves to improve storage efficiency and convenient setting when a plurality of cushions 10 need to be used and stored in a limited area. In addition, the elastic foam material preferably adopted for the prayer cushion 10 reserves optimal resiliency for even distribution of weight and pressure, thus maximizing the user satisfaction.

While the invention has been shown and described with reference to different embodiments thereof, it will be appreciated by those skilled in the art that variations in form, detail, compositions and operation may be made without departing from the spirit and scope of the invention as defined by the accompanying claims. For example, the prayer cushion 10 can be used for being seated cross-legged for purposes other than prayer.

What is claimed is:

1. A portable prayer cushion comprising a top surface partitioned to a front portion and a rear portion, wherein the front portion includes first and second loop lines each having a foremost point, wherein a first imaginary line through the first foremost point of the first loop line toward the rear portion of the top surface is substantially parallel to a second imaginary line through the second foremost point of the second loop line toward the rear portion of the top surface, wherein surface portions inside the loop lines are recessed to form first and second openings, wherein the cushion is rearwardly slanted from about a mid line dividing the front portion and the rear portion so that the cushion makes a rearward down-slope from the mid line.

2. A portable prayer cushion comprising a top surface partitioned to a front portion and a rear portion, wherein the front portion includes first and second loop lines each having a foremost point, wherein a first imaginary line through the first foremost point of the first loop line toward the rear portion of the top surface is substantially parallel to a second imaginary line through the second foremost point of the second loop line toward the rear portion of the top surface, wherein surface portions inside the loop lines are recessed to form first and second openings, wherein the cushion is rearwardly slanted from about a rearmost point of said each loop line so that the cushion makes a rearward down-slope from the rearmost point.

3. A portable prayer cushion comprising a top surface partitioned to a front portion and a rear portion by a first folding line, wherein the front portion includes first and second loop lines each having foremost and rearmost points, wherein a first imaginary line through the first foremost and rearmost points of the first loop line is substantially parallel to a second imaginary line through the second foremost and rearmost points of the second loop line, wherein surface portions inside the loop lines are recessed to form first and second openings, wherein the rear portion is hingedly foldable over on the front portion by the first folding line, wherein each of the first and second openings has a lowermost point.

4. The prayer cushion of claim 3 wherein a lowermost point in each of the first and second openings is positioned substantially closer to the foremost points than to the rearmost points.

5. The prayer cushion of claim 3 further comprising a peripheral surface substantially perpendicular to the top surface, wherein the top surface borders the peripheral surface by a front edge line, a rear edge line and side edge lines, wherein the front edge line is linear and perpendicular to the first and second imaginary lines.

6. The prayer cushion of claim 5 wherein the first and second loop lines are linearly aligned along the front edge line, wherein the side edge lines are each linear and substantially longer than the front edge line.

7. The prayer cushion of claim 3 wherein the front and rear portions of the top surface are about the same as each other in area.

8. The prayer cushion of claim 3 wherein the first and second loop lines are respectively circular or elliptical.

9. The prayer cushion of claim 3 wherein the depth from the top surface to the lowermost point is between about one fifth arid one half the thickness of the prayer cushion.

10. The prayer cushion of claim 3 wherein the depth from the top surface to the lowermost point is about one fifth the thickness of the prayer cushion.

11. The prayer cushion of claim 3 wherein the cushion is formed of an elastic polyurethane foam material.

12. The prayer cushion of claim 3 wherein the rear portion is partitioned to a first part and a second part by a second folding line with the first part between the front portion and the second part, wherein the second part is hingedly foldable over on the first part.

* * * * *